US011891924B2

(12) United States Patent
Guo et al.

(10) Patent No.: US 11,891,924 B2
(45) Date of Patent: Feb. 6, 2024

(54) ROCKER ARM MECHANISM AND ENGINE ASSEMBLY

(71) Applicant: WEICHAI POWER CO., LTD., Shandong (CN)

(72) Inventors: Shenggang Guo, Shandong (CN); Fei Wang, Shandong (CN); Cheng Xu, Shandong (CN)

(73) Assignee: WEICHAI POWER CO., LTD., Shandong (CN)

( * ) Notice: Subject to any disclaimer, the term of this patent is extended or adjusted under 35 U.S.C. 154(b) by 0 days.

(21) Appl. No.: 18/025,402

(22) PCT Filed: Dec. 7, 2020

(86) PCT No.: PCT/CN2020/134240
§ 371 (c)(1),
(2) Date: Mar. 9, 2023

(87) PCT Pub. No.: WO2022/052337
PCT Pub. Date: Mar. 17, 2022

(65) Prior Publication Data

US 2023/0332520 A1 Oct. 19, 2023

(30) Foreign Application Priority Data

Sep. 9, 2020 (CN) ..... 202010941905.4

(51) Int. Cl.
*F01L 1/18* (2006.01)
*F01L 13/06* (2006.01)
(Continued)

(52) U.S. Cl.
CPC ..... *F01L 1/181* (2013.01); *F01L 1/2411* (2013.01); *F01L 13/06* (2013.01); *F01L 1/267* (2013.01); *F01L 2001/2444* (2013.01)

(58) Field of Classification Search
CPC . F01L 1/181; F01L 1/2411; F01L 2001/2444; F01L 1/267; F01L 13/06
(Continued)

(56) References Cited

U.S. PATENT DOCUMENTS 6,253,730 B1 7/2001 Gustafson
6,422,186 B1 7/2002 Vanderpoel
(Continued)

FOREIGN PATENT DOCUMENTS

CN 201021640 Y 2/2008
CN 101142380 A 3/2008
(Continued)

OTHER PUBLICATIONS

International Search Report issued in corresponding International Application No. PCT/CN2020/134240, dated Jun. 7, 2021, pp. 1-2, English Translation.
(Continued)

*Primary Examiner* — Jorge L Leon, Jr.
(74) *Attorney, Agent, or Firm* — George Likourezos; Carter, Deluca & Farrell LLP

(57) ABSTRACT

A rocker arm mechanism includes a rocker arm shaft, a rocker arm, a valve clearance adjuster, a valve train, and a control valve. The rocker arm is rotatably disposed on the rocker arm shaft. The valve train includes a valve bridge. The rocker arm is provided with a plunger chamber. The valve clearance adjuster includes a hydraulic tappet slidably disposed in the plunger chamber. The plunger chamber is supplied with oil through an oil supply passage. The control valve is configured to open or close the oil supply passage. When the control valve opens the oil supply passage, the hydraulic tappet can abut against the valve bridge and eliminate the clearance between the valve bridge and the hydraulic tappet.

18 Claims, 4 Drawing Sheets

(51) Int. Cl.
*F01L 1/24* (2006.01)
*F01L 1/26* (2006.01)

(58) Field of Classification Search
USPC ..... 123/90.4, 90.44, 90.46
See application file for complete search history.

(56) References Cited

U.S. PATENT DOCUMENTS

| | | | | |
|---|---|---|---|---|
| 2002/0174654 | A1* | 11/2002 | Yang | F02M 26/06 60/602 |
| 2003/0024501 | A1 | 2/2003 | McCarthy et al. | |
| 2004/0112330 | A1 | 6/2004 | Hakansson et al. | |
| 2008/0223325 | A1 | 9/2008 | Meistrick | |
| 2012/0048232 | A1* | 3/2012 | Meistrick | F01L 1/18 123/321 |
| 2012/0279463 | A1 | 11/2012 | Moller | |
| 2016/0356187 | A1* | 12/2016 | Meneely | F01L 13/06 |
| 2017/0276035 | A1* | 9/2017 | Cecur | F01L 1/2416 |
| 2019/0048762 | A1 | 2/2019 | Choi et al. | |
| 2019/0145289 | A1* | 5/2019 | Ferreira | F01L 13/065 123/90.55 |
| 2020/0018243 | A1* | 1/2020 | Baltrucki | F02D 13/0242 |

FOREIGN PATENT DOCUMENTS

| | | | | |
|---|---|---|---|---|
| CN | 101349178 | A | | 1/2009 |
| CN | 201190586 | Y | | 2/2009 |
| CN | 201241740 | Y | | 5/2009 |
| CN | 101526018 | A | | 9/2009 |
| CN | 202348362 | U | | 7/2012 |
| CN | 103758606 | A | | 4/2014 |
| CN | 104500164 | A | | 4/2015 |
| CN | 104712396 | A | * | 6/2015 |
| CN | 105003314 | A | | 10/2015 |
| CN | 105683515 | A | | 6/2016 |
| CN | 106382140 | A | | 2/2017 |
| CN | 107035460 | A | | 8/2017 |
| CN | 107075988 | A | | 8/2017 |
| CN | 107636268 | A | | 1/2018 |
| CN | 208220854 | U | | 12/2018 |
| CN | 110425015 | A | | 11/2019 |
| CN | 110425016 | A | | 11/2019 |
| CN | 110566308 | A | | 12/2019 |
| CN | 110761868 | A | | 2/2020 |
| CN | 110886634 | A | | 3/2020 |
| CN | 210178434 | U | | 3/2020 |
| CN | 111255538 | A | * | 6/2020 |
| EP | 2711512 | A1 | | 3/2014 |
| GB | 893092 | A | | 4/1962 |
| GB | 2160945 | A | | 1/1986 |
| IN | 201358826 | Y | | 12/2009 |
| WO | 93/25803 | A1 | | 12/1993 |
| WO | 99/32773 | A1 | | 7/1999 |

OTHER PUBLICATIONS

1st Chinese Office Action issued in corresponding CN Patent Application No. 202010941905.4, dated Apr. 2, 2021, English Translation.

Li, L. et al., "Design & Research of Variable Valve Timing Train with Direct-Acting Hydraulic Lash Adjuster" Vehicle Engine (Aug. 2001) pp. 29-32, vol. 4, No. 134, with English language abstract.

Jianqiang, X. et al., "Ideas of improvements on valve actuating mechanisms of 16V240ZJB diesel engines" Experimental Research (Jul. 2000) pp. 1-9, vol. 7, with English language abstract.

Zhiming, L. et al., "Engine Hydraulic Tappet Valve Train" Internal Combustion Engines (Dec. 2007) pp. 1-3, vol. 6, with English language abstract.

* cited by examiner

ROCKER ARM MECHANISM AND ENGINE ASSEMBLY

CROSS-REFERENCE TO RELATED APPLICATION(S)

This is a national stage application filed under 37 U.S.C. 371 based on International Patent Application No. PCT/CN2020/134240, filed Dec. 7, 2020, which claims priority to Chinese Patent Application No. 202010941905.4, filed Sep. 9, 2020, the disclosure of which is incorporated herein by reference in its entirety.

TECHNICAL FIELD

The present application relates to the technical field of engines, for example, a rocker arm mechanism and an engine assembly.

BACKGROUND

A large vehicle driven by a heavy-duty or medium-duty diesel engine is generally provided with an engine braking mechanism. When an engine brakes, a braking piston of a braking rocker arm extends out under the drive of braking oil and cooperates with a valve bridge, causing the valve bridge to incline. A large clearance is generated between an elephant foot on an exhaust rocker and the valve bridge so that the exhaust valve cannot be closed. In this manner, the compressed air in the cylinder is released, and work cannot be performed externally.

However, in the related art, the use of an engine braking mechanism generally does not tolerate the situation where a hydraulic clearance adjuster is disposed on an exhaust rocker arm at the same time for clearance compensation. The hydraulic clearance adjuster is a hydraulic tappet for automatically adjusting the valve clearance of an engine as disclosed in the earlier patent application No. CN201010212462.1. Because when a clearance is generated, oil overfilling in a high-pressure chamber is caused. When braking stops, and an engine starts to fire and perform work, oil overfilling in the high-pressure chamber prevents oil in the high-pressure chamber from being discharged in time through a low-pressure chamber and the clearance between a plunger and a tappet body during a valve lift. Since oil is incompressible, the valve cannot be seated, leading to the situation where the valve is not tightly closed, and finally the valve is ablated or the valve collides with a piston.

SUMMARY

The present application provides a rocker arm mechanism and an engine assembly capable of dealing with the situation where the use of an engine braking mechanism generally does not tolerate the situation where a hydraulic clearance adjuster is disposed on an exhaust rocker arm at the same time for clearance compensation.

The embodiments of the present application provide a rocker arm mechanism. The rocker arm mechanism includes a rocker arm shaft, a rocker arm, a valve clearance adjuster, a valve train, and a control valve.

The rocker arm is rotatably disposed on the rocker arm shaft. The rocker arm is provided with a plunger chamber and an oil supply passage, and the plunger chamber is supplied with oil through the oil supply passage to supply oil.

The valve clearance adjuster is disposed on the rocker arm. The valve clearance adjuster includes a hydraulic tappet slidably disposed in the plunger chamber. The valve train includes a valve bridge.

The control valve is capable of opening or closing the oil supply passage. When the control valve opens the oil supply passage, the oil supplied by the oil supply passage goes into the plunger chamber and is capable of driving the hydraulic tappet to extend out relative to the rocker arm so that the hydraulic tappet abuts against the valve bridge. When the control valve closes the oil supply passage, the relative position between the hydraulic tappet and the rocker arm remains unchanged.

The control valve closes the oil supply passage when an engine brakes.

The embodiments of the present application provide an engine assembly. The engine assembly includes an engine. The engine includes a cylinder assembly. The cylinder assembly includes a cylinder, an intake mechanism, an exhaust mechanism, and a braking rocker arm. The exhaust mechanism is the rocker arm mechanism described above.

The exhaust mechanism is configured to control exhaust air, the intake mechanism is configured to control intake air, and the braking rocker arm can abut against the valve bridge of the exhaust mechanism to brake the engine.

REFERENCE LIST

Figure 1:
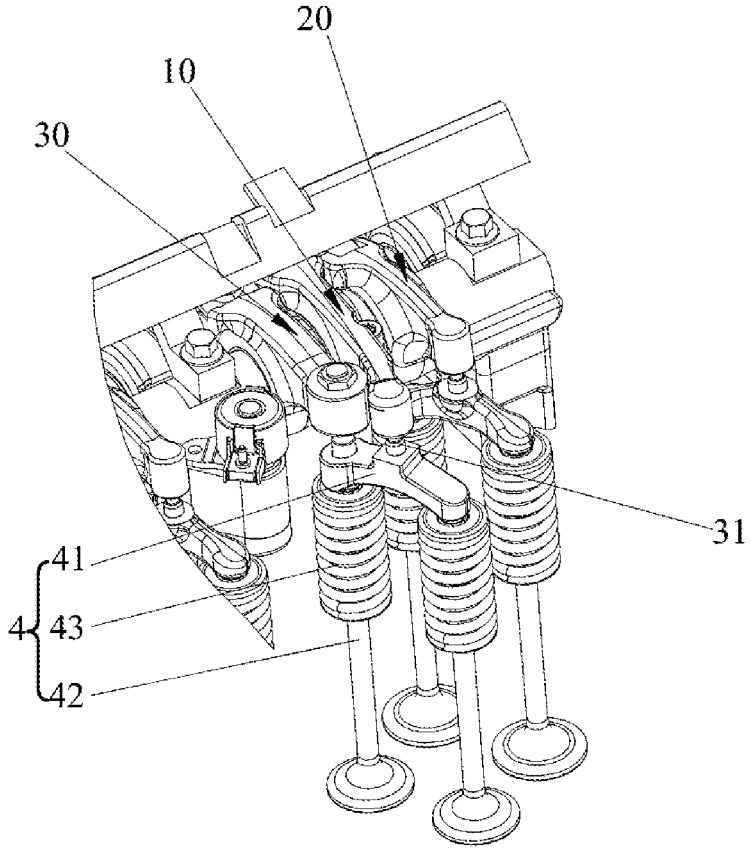
FIG. 1 is a view one illustrating the structure of an intake mechanism, an exhaust mechanism, and a braking rocker arm in an embodiment of the present application.
Figure 2:
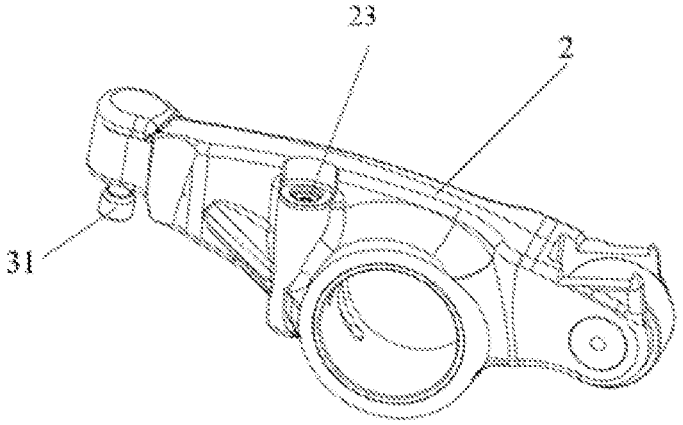
FIG. 2 is a view illustrating the structure of a rocker arm and a hydraulic clearance adjuster in an embodiment of the present application.
Figure 3:
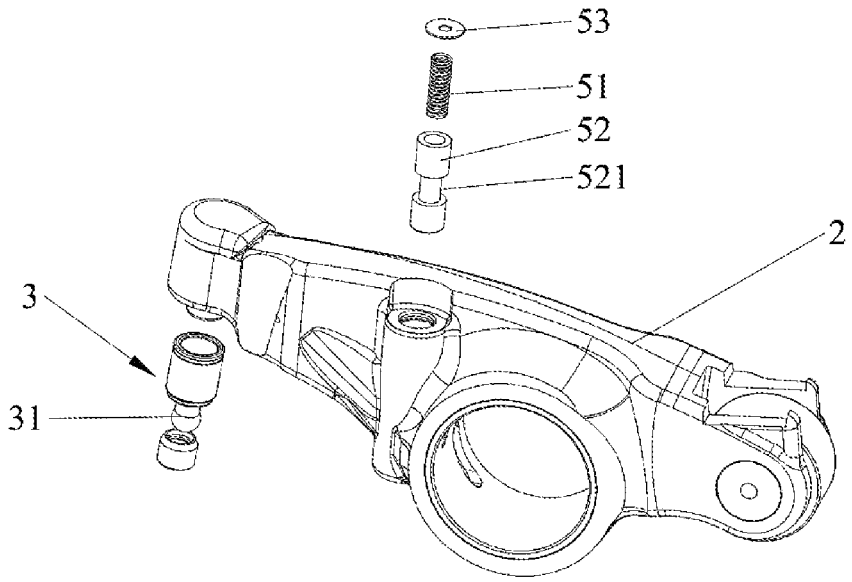
FIG. 3 is an exploded view of a rocker arm, a control valve, and a hydraulic clearance adjuster in an embodiment of the present application.
Figure 4:
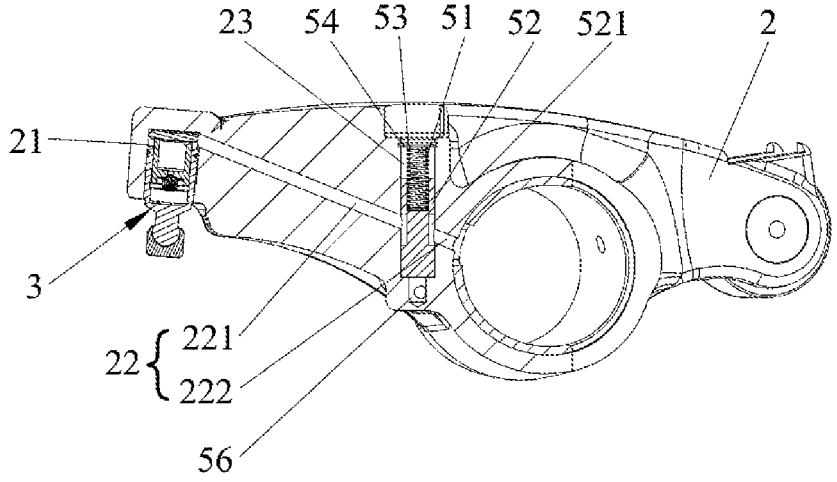
FIG. 4 is a sectional view of a rocker arm, a control valve, and a hydraulic clearance adjuster in an embodiment of the present application.

1 rocker arm shaft
11 lubricating oil passage
2 rocker arm
21 plunger chamber
22 oil supply passage
221 first oil passage
222 second oil passage
23 control chamber
3 valve clearance adjuster
31 hydraulic tappet
4 valve train
41 valve bridge
42 valve
43 valve spring
5 control valve

51 spring
52 valve core
521 oil guide slot
53 baffle
54 ring
55 control oil passage
56 connecting oil passage
57 control solenoid valve
58 braking solenoid valve
10 intake mechanism
20 exhaust mechanism
30 braking rocker arm
60 cylinder

DETAILED DESCRIPTION

In the description of the present application, it is to be noted that orientations or position relations indicated by terms such as "center", "upper", "lower", "left", "right", "vertical", "horizontal", "in", and "out" are orientations or position relations based on the drawings. These orientations or position relations are intended only to facilitate the description of the present application and simplify the description and not to indicate or imply that a device or element referred to must have such specific orientations or must be configured or operated in such specific orientations. Thus, these orientations or position relations are not to be construed as limiting the present application. In addition, terms such as "first" and "second" are used only for the purpose of description and are not to be construed as indicating or implying relative importance. Terms "first position" and "second position" are two different positions. Moreover, when the first feature is described as "on", "above", or "over" the second feature, the first feature is right on, above, or over the second feature or the first feature is obliquely on, above, or over the second feature, or the first feature is simply at a higher level than the second feature. When the first feature is described as "under", "below", or "underneath" the second feature, the first feature is right under, below, or underneath the second feature or the first feature is obliquely under, below, or underneath the second feature, or the first feature is simply at a lower level than the second feature.

In the description of the present application, it is to be noted that unless otherwise expressly specified and limited, the term "mounted", "connected to each other" or "connected" should be construed in a broad sense as securely connected, detachably connected or integrally connected; mechanically connected or electrically connected; directly connected to each other or indirectly connected to each other via an intermediary; or intraconnected between two components. For those of ordinary skill in the art, specific meanings of the preceding terms in the present application may be construed according to specific circumstances.

Embodiments of the present application are described in detail below, and examples of the embodiments are illustrated in the drawings, where the same or similar reference numerals indicate the same or similar elements or elements having the same or similar functions. The embodiments described below with reference to the drawings are illustrative and only for explaining the present application and not to be construed as limiting the present application.

As shown in FIGS. 1 to 7, this embodiment provides a rocker arm mechanism for controlling exhaust gas. The rocker arm mechanism can also be used for controlling intake air.

Figure 5:
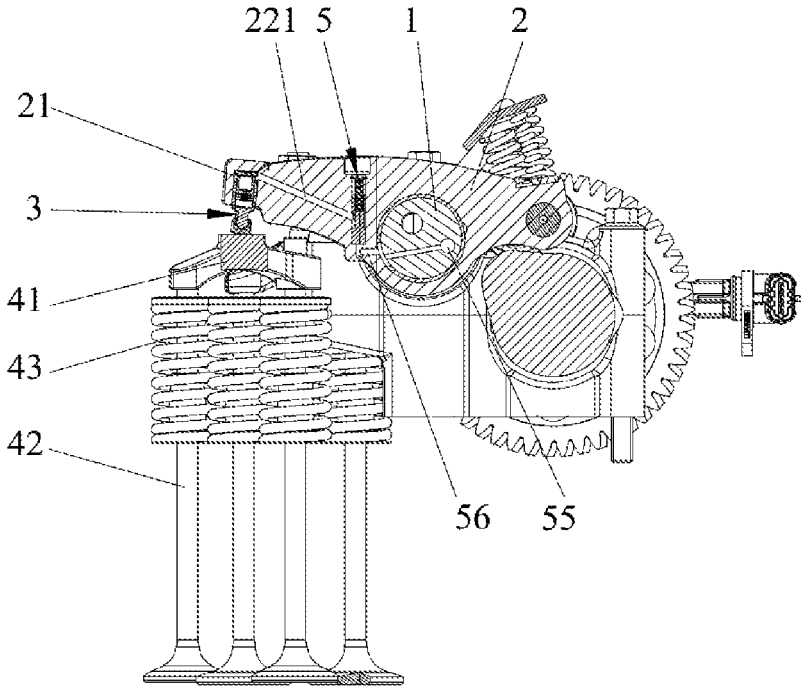
FIG. 5 is sectional view one of a rocker arm mechanism in an embodiment of the present application (a valve core is in the connection position).
Figure 6:
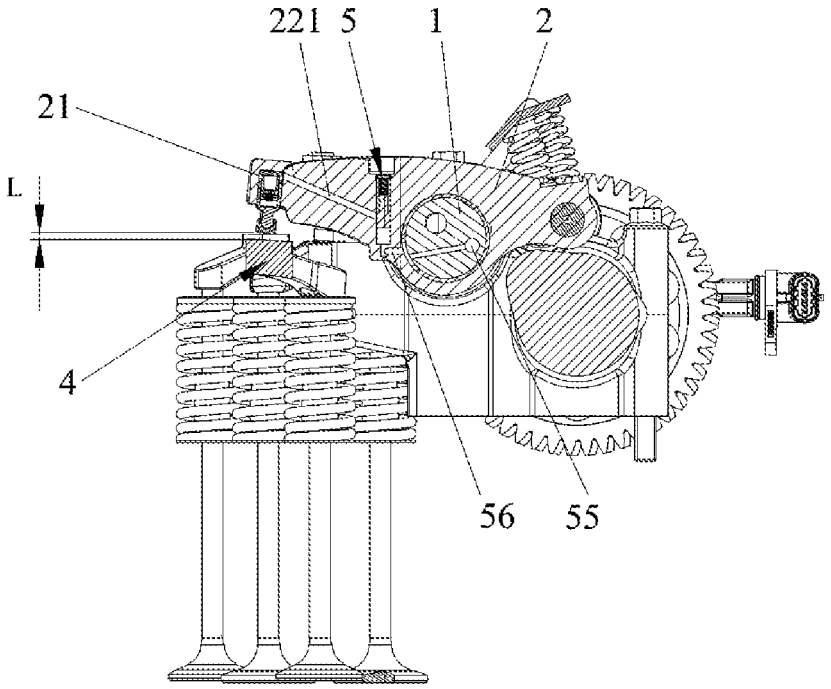
FIG. 6 is sectional view two of a rocker arm mechanism in an embodiment of the present application (a valve core is at the disconnection position).

The rocker arm mechanism includes a rocker arm shaft 1, a rocker arm 2, a valve clearance adjuster 3, a valve train 4, and a control valve 5. The rocker arm 2 is rotatably disposed on the rocker arm shaft 1. The valve clearance adjuster 3 is disposed on a first end of the rocker arm 2. A power source such as a push rod or a cam mechanism is configured to cooperate with a second end of the rocker arm 2 so that the rocker arm 2 can rotate around the rocker arm shaft 1. The valve clearance adjuster 3 and the valve train 4 may cooperate to control the exhaust passage to open or close. Illustratively, the valve train 4 includes a valve bridge 41, a valve 42 cooperating with the valve bridge 41, and a valve spring 43 sleeved on the valve 42. The valve 42 is configured to open or close an exhaust passage. The rocker arm 2 is provided with a plunger chamber 21. The valve clearance adjuster 3 includes a hydraulic tappet 31 slidably disposed in the plunger chamber 21. The plunger chamber 21 is supplied with oil through the oil supply passage 22. The control valve 5 can open or close the oil supply passage 22. When the control valve 5 opens the oil supply passage 22, as shown in FIG. 5, the oil supplied from the oil supply passage 22 enters the plunger chamber 21 and drives the hydraulic tappet 31 to extend out relative to the rocker arm 2. In this manner, the hydraulic tappet 31 abuts against the valve bridge 41 and eliminates the clearance between the valve bridge 41 and the hydraulic tappet 31. When the control valve 5 closes the oil supply passage 22, as shown in FIG. 6, the position of the hydraulic tappet 31 relative to the rocker arm 2 remains unchanged. At this time, if the engine brakes, a braking rocker arm 30 abuts against the valve bridge 41 so that the valve bridge 41 is at a set position. At this time, the valve 42 opens the exhaust passage. Since the oil supply passage 22 closes, and the position of the hydraulic tappet 31 relative to the rocker arm 2 remains unchanged, no oil is filled into the plunger chamber 21. As the rocker arm 2 rotates, the valve 42 is seated. During this process, the hydraulic tappet 31 and the valve bridge 41 can be separated and have a clearance L. Thus, a compression release brake and a hydraulic clearance adjuster can be compatible, and the situation where the valve 42 is ablated or the valve 42 collides with a piston can be avoided.

The valve clearance adjuster 3 is a related art. For the operating principle of the valve clearance adjuster 3, reference may be made to the hydraulic tappet for automatically adjusting the valve clearance of the engine disclosed in the earlier patent application No. CN 201010212462.1. The structure and the operating principle of the valve clearance adjuster 3 are not described in detail in this embodiment.

Optionally, referring to FIGS. 2 to 6, the rocker arm 2 is provided with a control chamber 23, and the oil supply passage 22 includes a first oil passage 221 and a second oil passage 222. The first oil passage 221 and the second oil passage 222 are spaced apart on the rocker arm 2. Both the first oil passage 221 and the second oil passage 222 are configured to communicate with the control chamber 23. The first oil passage 221 is configured to communicate with the plunger chamber 21. The second oil passage 222 is configured to be connected to an oil source. The control valve 5 includes a valve core 52 slidably located in the control chamber 23. The valve core 52 is configured to make the first oil passage 221 and the second oil passage 222 connected or disconnected. For this reason, the control valve 5 may be integrated with the rocker arm 2 to save installation space. In this embodiment, the oil supply passage 22 is configured to communicate with a lubricating oil passage 11 (see FIG. 7) disposed on the rocker arm shaft 1. In other embodiments, the oil supply passage 22 may also be configured as an external oil pipe disposed outside the rocker arm 2.

Optionally, the control valve 5 also includes a spring 51 disposed at a first end of the control chamber 23 and a pilot signal oil passage communicating with a second end of the control chamber 23. The valve core 52 has a connection position for connection of the first oil passage 221 and the second oil passage 222 and a disconnection position for disconnection of the first oil passage 221 and the second oil passage 222. The spring 51 can drive the valve core 52 to move towards the connection position. The pilot signal oil passage can drive the valve core 52 to move towards the disconnection position. In this embodiment, the control valve 5 is a pilot valve adopting a mechanical structure that has a stable control effect. Optionally, the valve core 52 is provided with an oil guide slot 521. The oil guide slot 521 is configured to be connected to the first oil passage 221 and the second oil passage 222 when the valve core 52 is at the connection position, and be disconnected from the first oil passage 221 and the second oil passage 222 when the valve core 52 is at the disconnection position. Illustratively, when the valve core 52 is located in the connection position, the oil guide slot 521 is located between the first oil passage 221 and the second oil passage 222. When the valve core 52 is located at the disconnection position, and the outer peripheral surface of the valve core 52 separates the first oil passage 221 and the second oil passage 222. Optionally, the oil guide slot 521 may be an annular groove surrounding the valve core 52 so that when the oil guide slot 521 is connected to the first oil passage 221 and the second oil passage 22, the communication effect is not affected by the rotation of the valve core 52. Optionally, the oil guide slot 521 may also be a slot passing through the peripheral surface of the valve core 52. As an optional embodiment, the control valve 5 may also be a solenoid control valve capable of communicating the second oil passage 222 with the first oil passage 221 or communicating the second oil passage 222 with an oil tank.

Optionally, the control valve 5 also includes a baffle 53 and a ring 54 which are disposed in the control chamber 23. The ring 54 and the spring 51 are disposed on two different sides of the baffle 53. The two ends of the spring 51 abut against the baffle 53 and valve core 52 respectively. The ring 54 engages with the chamber wall of the control chamber 23 and abuts against the baffle 53. The spring 51 may also directly abut against the chamber wall of the control chamber 23 or abut against the bolt screwed to the chamber wall of the control chamber 23.

Optionally, the pilot signal oil passage includes a control oil passage 55 for supplying oil to the control chamber 23 and a valve member configured to control the control oil passage 55 to open or close. When the valve member is configured to open the control oil passage 55, the control oil passage 55 supplies oil to the control chamber 23 to move the valve core 52 to the disconnection position. At this time, the first oil passage 221 and the second oil passage 222 are disconnected so that the relative position between the hydraulic tappet 31 and the rocker arm 2 is locked. When the valve member is configured to close the control oil passage 55, the control oil passage 55 cannot supply oil to the control chamber 23. Under the action of the spring 51, the valve core 52 moves to the connection position. At this time, the first oil passage 221 and the second oil passage 222 are communicated so that the relative position between the hydraulic tappet 31 and the rocker arm 2 can be unlocked. Optionally, the control oil passage 55 is disposed on the rocker arm shaft 1. The pilot signal oil passage also includes a connecting oil passage 56 disposed on the rocker arm 2, and the connecting oil passage 56 connects the control oil passage 55 and the control chamber 23.

Optionally, the control oil passage 55 is a braking oil passage for supplying oil to the braking rocker arm 30. The valve member is a braking solenoid valve 58. When the braking solenoid valve 58 opens the braking oil passage, the braking rocker arm 30 is used for engine braking. In this manner, when the valve member is configured to open the braking oil passage, in one aspect, the braking oil passage supplies oil to the braking rocker arm 30 to perform engine braking. In another aspect, the braking oil passage supplies oil to the control chamber 23 to move the valve core 52 to the disconnection position, and the relative position between the hydraulic tappet 31 and the rocker arm 2 is locked. The braking oil passage is S1 as shown in FIG. 7.

Figure 7:
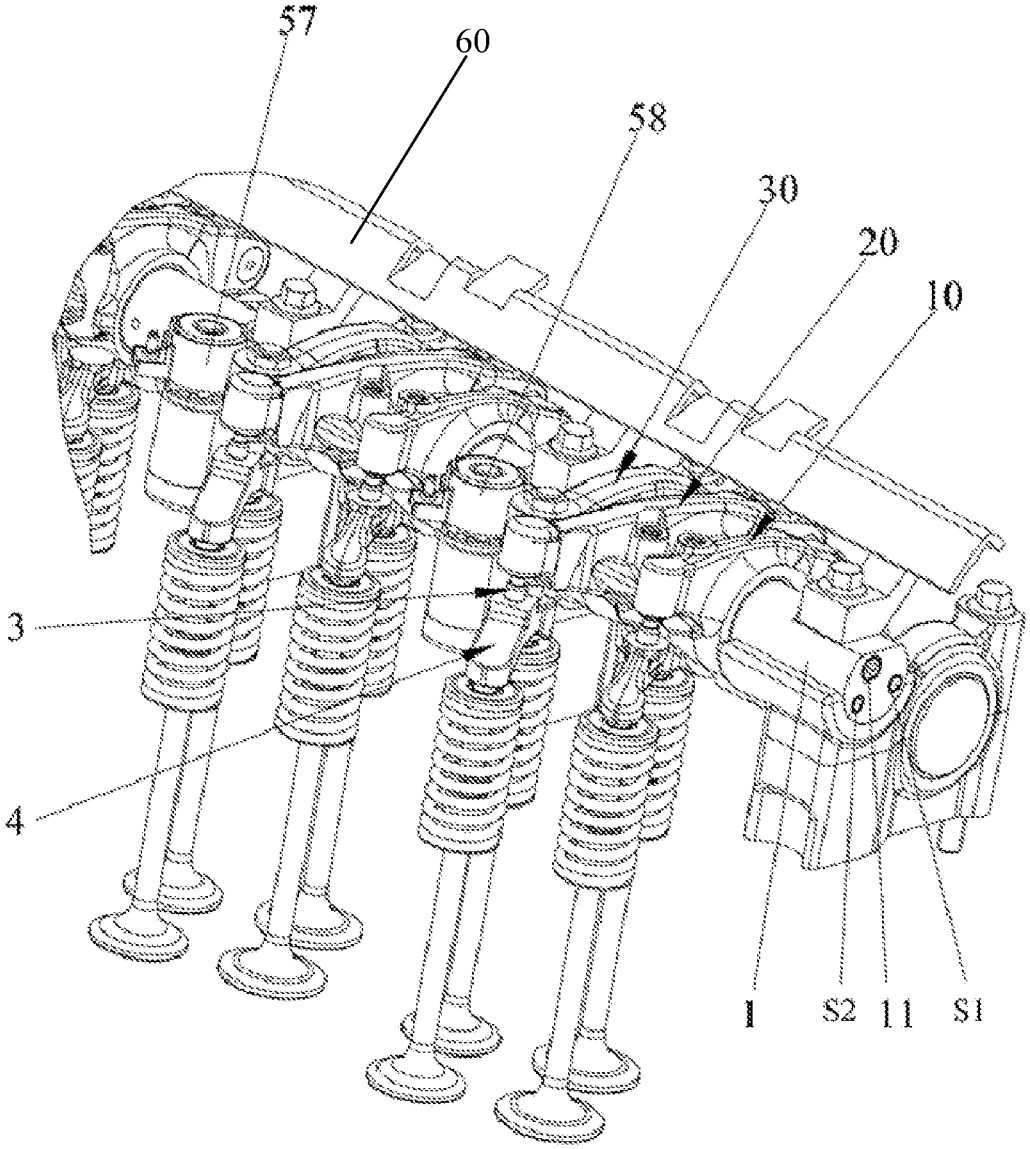
FIG. 7 is view two illustrating the structure of an intake mechanism, an exhaust mechanism, and a braking rocker arm in an embodiment of the present application.

Alternatively, the control oil passage 55 is a dedicated oil passage independent of the braking oil passage, as shown as S2 in FIG. 7. Illustratively, the valve member is a control solenoid valve 57, and the dedicated oil passage is configured to only communicate the oil source and the control chamber 23. Optionally, when the rotational speed of the engine exceeds a set value, the control solenoid valve 57 controls the dedicated oil passage to open so that the problem that when the engine is in an over speeding state, the clearance between the valve bridge 41 and the hydraulic clearance adjuster becomes bigger because the valve train 4 flies off, and oil overfilling of the hydraulic clearance adjuster can be avoided.

The embodiments also provide an engine assembly. The engine includes a cylinder assembly. The cylinder assembly includes a cylinder 60, an intake mechanism 10, an exhaust mechanism 20, and a braking rocker arm 30. The exhaust mechanism 20 is the preceding rocker arm mechanism. The exhaust mechanism 20 is configured to control air exhaust, the intake mechanism 10 is configured to control air intake. The braking rocker arm 30 can abut against the valve bridge 41 of the exhaust mechanism 20 to brake the engine.

Optionally, the rocker arm mechanism may be adopted by the preceding intake mechanism 10. For example, when the control oil passage 55 is independent of the braking oil passage, and when the rotational speed of the engine exceeds a set value, the valve members of the intake mechanism 10 and the exhaust mechanism 20 control the corresponding oil passages to open at the same time so that the problem of oil overfilling of the hydraulic clearance adjusters of the intake mechanism 10 and the exhaust mechanism 20 can be avoided. Optionally, the intake mechanism 10 may be different from the preceding rocker arm mechanism.

What is claimed is:

1. A rocker arm mechanism for an engine, the rocker arm mechanism comprising:

a valve train including a valve bridge; and a rocker arm pivotally disposed on a rocker arm shaft, the rocker arm including:

a plunger chamber;

a valve clearance adjuster including a hydraulic tappet slidably disposed in the plunger chamber;

an oil supply passage configured to supply oil to the plunger chamber; and a hydraulically actuated control valve configured to alternately open and close the oil supply passage, wherein the oil supplied to the plunger chamber extends the hydraulic tappet out of the rocker arm so as to abut against the valve bridge when the control valve opens the oil supply passage, wherein a position of the hydraulic tappet relative to the rocker arm remains unchanged when oil from a pilot signal oil passage drives the control valve so as to close the oil supply passage, and wherein the control valve closes the oil supply passage during an engine braking operation of the engine.

2. The rocker arm mechanism according to claim 1, wherein the rocker arm further includes a control chamber configured to receive the control valve, the control chamber dividing the oil supply passage into:

a first oil passage connecting the control chamber to the plunger chamber, and a second oil passage connecting the control chamber to an oil source, and wherein the control valve includes a valve core slidably disposed in the control chamber between the first oil passage and the second oil passage, the valve core configured to switch between:

a connection position in which the first oil passage is connected to the second oil passage thereby opening the oil supply passage, and a disconnection position in which the first oil passage is disconnected from the second oil passage thereby closing the oil supply passage.

3. The rocker arm mechanism according to claim 2, wherein the control valve further includes a spring disposed at a first end of the control chamber, the spring configured to bias the valve core towards the connection position, and wherein the pilot signal oil passage communicates with a second end of the control chamber such that the oil from the pilot signal oil passage drives the valve core towards the disconnection position.

4. The rocker arm mechanism according to claim 3, wherein the valve core includes an oil guide slot configured to be in alignment with the first oil passage and the second oil passage when the valve core is in the connection position, and wherein the oil guide slot is moved out of alignment with the first oil passage and the second oil passage when the valve core is switched to the disconnection position.

5. The rocker arm mechanism according to claim 3, wherein the pilot signal oil passage includes:

a control oil passage configured to supply the oil to the control chamber, and a valve member configured to selectively open the control oil passage.

6. The rocker arm mechanism according to claim 5, wherein:

the rocker arm is a braking rocker arm, the control oil passage is a braking oil passage, the valve member is a braking solenoid valve, and the braking rocker arm is configured to execute the engine braking operation when the braking solenoid valve opens the braking oil passage.

7. The rocker arm mechanism according to claim 5, wherein the control oil passage is a dedicated oil passage configured to communicate only with the oil source and the control chamber, and wherein the valve member is a control solenoid valve configured to open the control oil passage when a rotational speed of the engine exceeds a set value.

8. The rocker arm mechanism according to claim 5, wherein the control oil passage is disposed in the rocker arm shaft, and wherein the pilot signal oil passage further includes a connecting oil passage disposed in the rocker arm, the connecting oil passage configured to connect the control oil passage to the control chamber.

9. The rocker arm mechanism according to claim 3, wherein the control valve further includes a baffle and a ring each disposed in the control chamber such that the spring is pressed between the baffle and the valve core, and the baffle abuts against the ring which engages with a chamber wall of the control chamber.

10. An engine assembly, comprising:

an engine including:

a cylinder, an intake rocker arm mechanism configured to control air intake into the cylinder, an exhaust rocker arm mechanism including the rocker arm mechanism according to claim 1, the exhaust rocker arm mechanism configured to control air exhaust of the cylinder, and a braking rocker arm configured to abut against the valve bridge so as to execute the engine braking operation of the engine.

11. The engine assembly according to claim 10, wherein the rocker arm further includes a control chamber configured to receive the control valve, the control chamber dividing the oil supply passage into:

a first oil passage connecting the control chamber to the plunger chamber, and a second oil passage connecting the control chamber to an oil source, and wherein the control valve includes a valve core slidably disposed in the control chamber between the first oil passage and the second oil passage, the valve core configured to switch between:

a connection position in which the first oil passage is connected to the second oil passage thereby opening the oil supply passage, and a disconnection position in which the first oil passage is disconnected from the second oil passage thereby closing the oil supply passage.

12. The engine assembly according to claim 11, wherein the control valve further includes a spring disposed at a first end of the control chamber, the spring configured to bias the valve core towards the connection position, and wherein the pilot signal oil passage communicates with a second end of the control chamber such that the oil from the pilot signal oil passage drives the valve core towards the disconnection position.

13. The engine assembly according to claim 12, wherein the valve core includes an oil guide slot configured to be in alignment with the first oil passage and the second oil passage when the valve core is in the connection position, and be disconnected from wherein the oil guide slot is moved out of alignment with the first oil passage and the second oil passage when the valve core is switched to the disconnection position.

14. The engine assembly according to claim 12, wherein the pilot signal oil passage includes:

a control oil passage configured to supply the oil to the control chamber, and a valve member configured to selectively open the control oil passage.

15. The engine assembly according to claim 14, wherein:

the rocker arm is a braking rocker arm, the control oil passage is a braking oil passage, the valve member is a braking solenoid valve, and the braking rocker arm is configured to execute the engine braking operation when the braking solenoid valve opens the braking oil passage.

16. The engine assembly according to claim 14, wherein the control oil passage is a dedicated oil passage configured to communicate only with the oil source and the control chamber, and wherein the valve member is a control solenoid valve configured to open the control oil passage when a rotational speed of the engine exceeds a set value.

17. The engine assembly according to claim 14, wherein the control oil passage is disposed in the rocker arm shaft, and wherein the pilot signal oil passage further includes a connecting oil passage disposed in the rocker arm, the connecting oil passage configured to connect the control oil passage to the control chamber.

18. The engine assembly according to claim 12, wherein the control valve further includes a baffle and a ring each disposed in the control chamber such that the spring is pressed between the baffle and the valve core, and the baffle abuts against the ring which engages with a chamber wall of the control chamber.

* * * * *